US009408289B2

(12) United States Patent
Hannon

(10) Patent No.: US 9,408,289 B2
(45) Date of Patent: Aug. 2, 2016

(54) METHOD FOR MAXIMIZING THE BRIGHTNESS OF THE BUNCHES IN A PARTICLE INJECTOR BY CONVERTING A HIGHLY SPACE-CHARGED BEAM TO A RELATIVISTIC AND EMITTANCE-DOMINATED BEAM

(71) Applicant: JEFFERSON SCIENCE ASSOCIATES, LLC, Newport News, VA (US)

(72) Inventor: Fay Hannon, Poquoson, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 0 days.

(21) Appl. No.: 14/638,319

(22) Filed: Mar. 4, 2015

(65) Prior Publication Data

US 2015/0257247 A1 Sep. 10, 2015

Related U.S. Application Data

(60) Provisional application No. 61/950,142, filed on Mar. 9, 2014.

(51) Int. Cl.
*H05H 7/02* (2006.01)
*H05H 7/00* (2006.01)

(52) U.S. Cl.
CPC ..... *H05H 7/001* (2013.01); *H05H 7/02* (2013.01); *H05H 2007/004* (2013.01); *H05H 2007/025* (2013.01)

(58) Field of Classification Search
USPC ..... 315/501, 500
See application file for complete search history.

(56) References Cited

U.S. PATENT DOCUMENTS

| | | | | |
|---|---|---|---|---|
| 7,474,296 | B2 * | 1/2009 | Obermeyer | G05G 9/047 345/156 |
| 7,755,069 | B2 * | 7/2010 | Zolotorev | H01J 37/06 250/423 R |
| 8,787,529 | B2 * | 7/2014 | Graves | H05G 2/00 250/493.1 |
| 9,040,936 | B1 * | 5/2015 | Douglas | H01S 3/0903 250/396 R |
| 2008/0173829 | A1 * | 7/2008 | Zolotorev | H01J 37/06 250/423 R |
| 2009/0310731 | A1 * | 12/2009 | Burke | G21B 1/03 376/100 |
| 2012/0288065 | A1 * | 11/2012 | Graves | H05G 2/00 378/119 |
| 2012/0309415 | A1 * | 12/2012 | Rhoads | G01S 5/0273 455/456.1 |
| 2012/0328066 | A1 * | 12/2012 | Burke | G21B 1/03 376/111 |
| 2015/0156859 | A1 * | 6/2015 | Douglas | H05H 7/00 315/505 |
| 2015/0160351 | A1 * | 6/2015 | Xi | G01R 33/0041 250/227.23 |
| 2015/0163895 | A1 * | 6/2015 | Biallas | H05H 7/20 285/18 |

* cited by examiner

*Primary Examiner* — Douglas W Owens
*Assistant Examiner* — Srinivas Sathiraju

(57) ABSTRACT

A method for maximizing the brightness of the bunches in a particle injector by converting a highly space-charged beam to a relativistic and emittance-dominated beam. The method includes 1) determining the bunch charge and the initial kinetic energy of the highly space-charge dominated input beam; 2) applying the bunch charge and initial kinetic energy properties of the highly space-charge dominated input beam to determine the number of accelerator cavities required to accelerate the bunches to relativistic speed; 3) providing the required number of accelerator cavities; and 4) setting the gradient of the radio frequency (RF) cavities; and 5) operating the phase of the accelerator cavities between −90 and zero degrees of the sinusoid of phase to simultaneously accelerate and bunch the charged particles to maximize brightness, and until the beam is relativistic and emittance-dominated.

1 Claim, 4 Drawing Sheets

METHOD FOR MAXIMIZING THE BRIGHTNESS OF THE BUNCHES IN A PARTICLE INJECTOR BY CONVERTING A HIGHLY SPACE-CHARGED BEAM TO A RELATIVISTIC AND EMITTANCE-DOMINATED BEAM

This application claims the priority of Provisional U.S. Patent Application Ser. No. 61/950,142 filed Mar. 9, 2014.

The United States Government may have certain rights to this invention under Management and Operating Contract No. DE-AC05-06OR23177 from the Department of Energy.

FIELD OF THE INVENTION

The present invention relates to particle beams and more particularly to a method for preserving the 6D brightness of highly space-charge dominated beams.

BACKGROUND

In particle accelerators, the motion of particle bunches at low energy is typically dominated by space-charge effects. For space-charge dominated particle beams (e.g. as found in injectors), it is not possible to operate particle accelerators in conventional ways to fully preserve the six-dimensional (6D) brightness of the bunch and approach the theoretical brightness limit.

Typically, radio frequency (RF) structures are used to either bunch or accelerate the particle bunches independently, which modifies (to the $1^{St}$ order) 2D longitudinal phase space or 4D transverse phase space respectively. In order to preserve the 6D brightness of highly space-charge dominated beams, RF cavities must be operated in a way such that both bunching and acceleration occur simultaneously and optimally in such a manner that brightness is not destroyed. This process can be repeated in subsequent cavities with varying degrees of bunching/accelerating until the bunch is no longer space-charge dominated. The geometry, gradient and phase of the cavities are all required to optimally preserve bunch brightness and approach the brightness limit.

Accordingly, it would be advantageous to provide a method for operating RF cavities in such a manner that bunching and acceleration occur simultaneously and the six-dimensional brightness of the bunch is preserved.

OBJECT OF THE INVENTION

The object of the present invention is to provide a method for preserving the 6D brightness of highly space-charge dominated charged particle beams.

A further object is to provide a method for operating RF cavities in a way such that both bunching and acceleration occur simultaneously and optimally in such a manner that brightness is not destroyed and thereafter repeating this process in subsequent cavities with varying degrees of bunching/accelerating until the bunch is no longer space-charge dominated.

SUMMARY OF THE INVENTION

The present invention provides a method for preserving the six-dimensional (6D) brightness of highly space-charge dominated charged particle beam using combined function, multiple cavities for six dimensional phase space preservation of particle cavities. The number of cavities required to accelerate the bunch to a non space-charge dominated regime depends both on the bunch charge and the initial kinetic energy of the bunch. Lower charge and higher energy will both result in fewer combined function cavities. A non space-charge dominated bunch is said to be emittance dominated. This invention is applicable to all types of charged particles that can be accelerated by standard RF cavities. As an example, five accelerator cavities are used to achieve an emittance dominated and relativistic electron bunch in an injector. The first four cavities use a combination of accelerating and bunching to maintain bunch brightness. The last cavity is operated to only accelerate the electrons.

For six-dimensional phase space preservation, the cavities are operated at between −90 and 0 degrees of the sinusoid of phase (as shown in FIG. 1), to enable bunching and accelerating to happen simultaneously, in proportion to one another so that the 6D phase space doesn't expand.

BRIEF DESCRIPTION OF THE SEVERAL VIEWS OF THE DRAWING(S)

Reference is made herein to the accompanying drawings, which are not necessarily drawn to scale, and wherein:

FIG. 1 is a plot schematically depicting the sinusoid of RF gradient versus phase in an RF accelerator structure. Zero degrees phase is defined as that at which maximum energy gain of the particle bunch occurs. Phase values of −90 and +90 degrees correspond to no energy gain.

DETAILED DESCRIPTION

When the motion of particle bunches are severely space-charge dominated, it is no longer possible to use standard accelerator components in conventional ways to preserve the six-dimensional brightness of the bunch. Typically, RF structures are used to either bunch or accelerate the particle bunches independently, which modifies (to the 1 st order) 2D longitudinal phase space or 4D transverse phase space respectively. Conventional accelerators will have bunching cavities followed by separate accelerating cavities. In order to preserve the 6D brightness of highly space-charge dominated beams, RF cavities must be operated in a way such that both bunching and acceleration occur simultaneously and optimally so brightness is not destroyed. This process can be repeated in subsequent cavities with varying degrees of bunching/accelerating until the bunch is no longer space-charge dominated. The geometry, gradient and phase of the cavities are all required to optimally preserve bunch brightness and approach the brightness limit.

The six-dimensional phase space preservation method of the present invention can be used in any scenario where space-charge is severe in a particle accelerator. Typically, this is when the particle source can't deliver fully relativistic bunches in injectors. For example, DC electron guns with low exit energy (few keV) or moderate (few MeV) energy guns in high charge operation.

Rather than designing RF cavities that either bunch or accelerate, the six-dimensional phase space preservation method uses cavities that can do both optimally. In conventional injectors, the action of bunching and accelerating are separate for ease of operation, cost, and historically because 6D brightness has not been pushed to theoretical limits. For these cavities to work optimally, transit time of the incident charged particle bunch must be considered in designing the shape of the cavity, such that bunching and acceleration happens efficiently in each. Conventional techniques try to avoid the space-charge dominated regime with higher injection energies.

Figure 1:
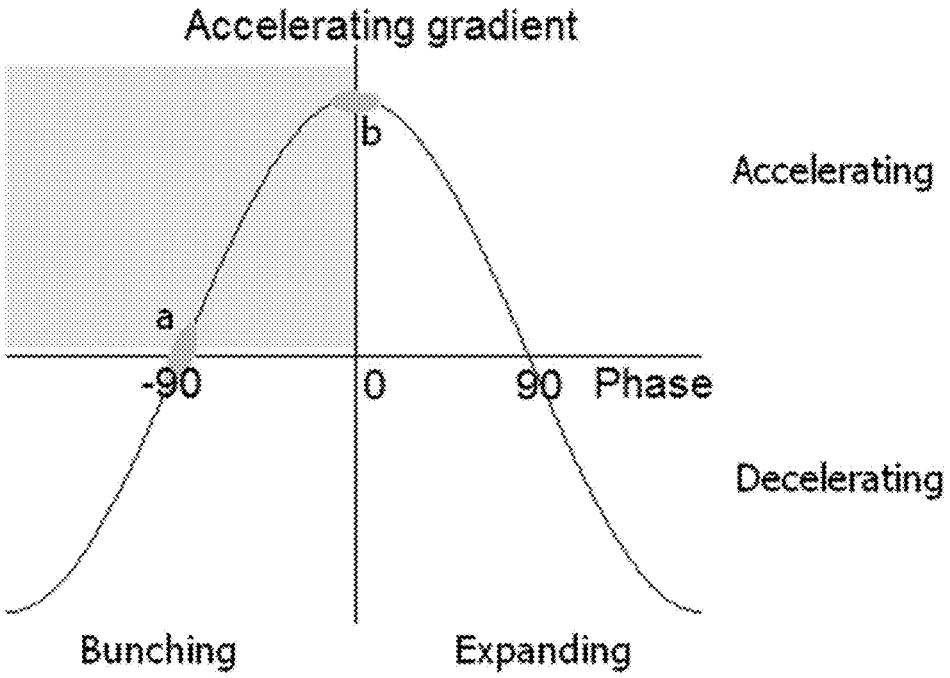

Brightness is the bunch charge per unit volume of the bunch, essentially charge over 6D phase space. With reference to FIG. 1, charged particle bunches are typically placed at position (a) for bunching (no energy gain) or (b) for accelerating (no bunching). In practice, the bunches have a finite length and transit the cavity at less than the speed of light, so often there is phase slippage in cavities, so some acceleration/deceleration/bunching/expanding happens by nature. Conventional accelerating cavities are typically operated between around +/−20 degrees to avoid imposing the RF curvature of the sinusoid on the bunch. Depending on the length and energy of the bunch, there may be bunching or expansion as a consequence.

For six-dimensional phase space preservation according to the present invention, operation would be purposefully in the upper left quadrant of FIG. 1 such that bunching and accelerating happen simultaneously, in proportion to one another so that the 6D phase space doesn't increase. Over-bunching longitudinally, while non-elativistic, will cause the normalized transverse 4D (and therefore 6D) phase space to expand. Also the transverse focusing electric fields in the cavity, which are at a maximum at 0 degrees (i.e. at maximum accelerating phase), can cause the longitudinal phase space to expand if the bunch is over-focused transversely. Both the transverse focusing electric fields in the cavities, and bunching act to reduce the 6D phase space volume. Space charge forces act to increase the 6D phase space. By accelerating the bunch to relativistic speeds, the space charge effects are reduced and the 6D phase space is better preserved. So one can see that there is a trade-off between the two functions, and combining them is more optimal than having them separate. This becomes more important with space charge dominated beams, as the non-linear forces cause irretrievable brightness degradation.

Figure 2:
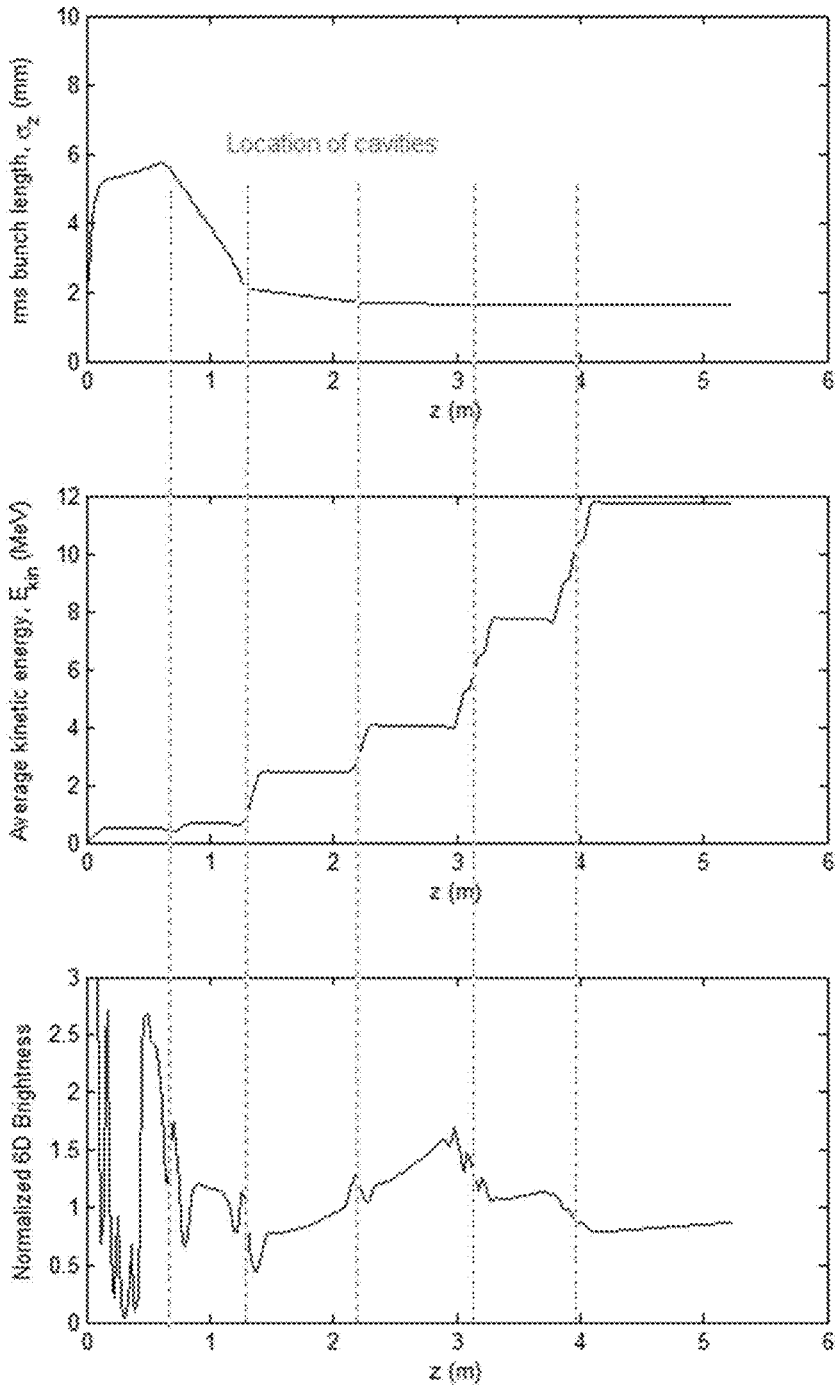
FIG. 2 depicts an example from a simulation that uses five cavities to achieve a relativistic, emittance dominated electron beam.
Figure 3:
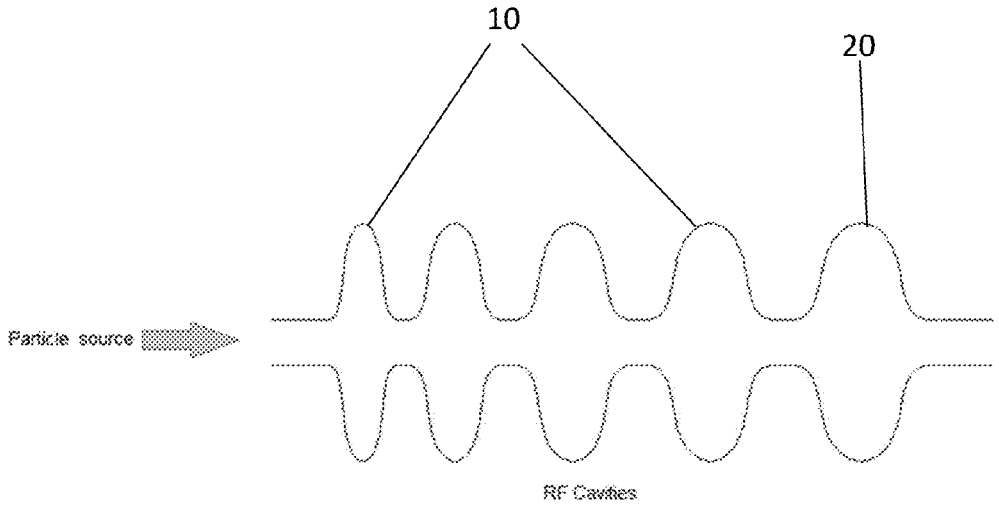
FIG. 3 depicts an accelerator structure for preserving the six-dimensional brightness of highly space-charge dominated charged particle beams.

With reference to FIG. 2, there is shown an example from a simulation that uses 5 initial cavities (of varying number of cells) to get an electron beam emittance-dominated and relativistic. As shown in Fig. 3, The first 4 the initial cavities 10 use a combination of accelerating and bunching to maintain beam brightness. Velocity bunching with cavities becomes increasingly ineffective at higher electron bunch energies. The final cavity 20 in this example only accelerates. This set up isn't optimal as there is some phase slippage in the cavities as the length has not been optimized.

For a particular layout such as shown in FIG. 2, to approach the 6D beam parameters desired, the first 4 cavities had to bunch as well as accelerate as there was no dedicated buncher cavity. The amount of bunching decreases while the amount of acceleration increases as the bunch encounters each cavity in order from the particle source. For ultimate brightness, multiple cavities must be used in a bunching/accelerating combination until the beam is relativistic and emittance dominated.

Figure 4:
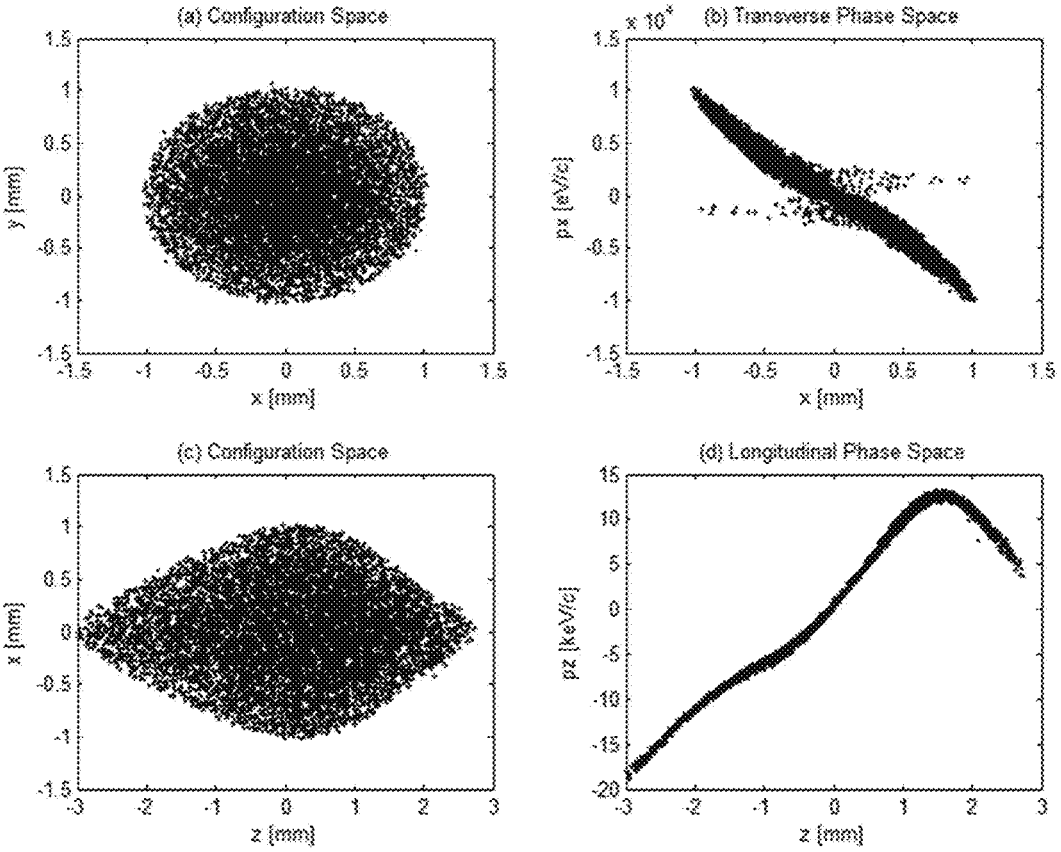
FIG. 4 is a plot graphically depicting the six-dimensional phase space obtained by the method of the present invention, wherein graphs (a) and (c) show the beam projection in 2D Cartesian coordinates, graph (b) shows the transverse phase space in the x (horizontal) direction, and graph (d) shows the longitudinal phase space in the z direction.

A graphical depiction of the six dimensional phase space is shown in FIG. 4. FIG. 4 is a graphically depicts the six-dimensional phase space obtained by the method of the present invention. The beam projection in 2D Cartesian coordinates are depicted in graphs (a) and (c), the transverse phase space in the x (horizontal) direction is depicted in graph (b), and the longitudinal phase space in the z direction is depicted in graph (d), where px and pz are the horizontal and longitudinal momentum respectively. In this example, not shown, the vertical phase space (y direction) is identical to the horizontal phase space. Brightness is proportional to 1/phase space volume.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for maximizing the brightness of a bunch of charged particles in a particle injector, comprising:

a. providing an input beam;

b. determining the bunch charge and the initial kinetic energy of the highly space-charge dominated input beam;

c. applying the bunch charge and initial kinetic energy properties of the highly space-charge dominated input beam to determine a number of accelerator cavities required to accelerate the bunches to relativistic speed;

d. providing the required number of accelerator cavities;

e. setting the gradient of the radio frequency (RF) cavities; and f. operating the accelerator cavities at a phase between −90 and zero degrees of the sinusoid of phase to simultaneously accelerate and bunch the charged particles until the beam is relativistic and emittance-dominated.

* * * * *